US009238530B2

(12) United States Patent
Possell et al.

(10) Patent No.: US 9,238,530 B2
(45) Date of Patent: Jan. 19, 2016

(54) WATERTIGHT CLOSURE SYSTEM

(71) Applicant: Kimberly-Clark Worldwide, Inc., Neenah, WI (US)

(72) Inventors: Kevin Christopher Possell, Middleton, WI (US); Maggie VanderHeiden Berger, Appleton, WI (US); Jason Robert Boon, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 13/773,278

(22) Filed: Feb. 21, 2013

(65) Prior Publication Data

US 2014/0231445 A1 Aug. 21, 2014

(51) Int. Cl.

| | |
|---|---|
| ***B65D 51/18*** | (2006.01) |
| ***B65D 43/16*** | (2006.01) |
| *B65D 83/08* | (2006.01) |

(52) U.S. Cl.

CPC ..... *B65D 43/169* (2013.01); *B65D 83/08* (2013.01); *B65D 2543/0049* (2013.01); *B65D 2543/0074* (2013.01); *B65D 2543/00101* (2013.01); *B65D 2543/00296* (2013.01); *B65D 2543/00537* (2013.01); *B65D 2543/00805* (2013.01); *B65D 2543/00842* (2013.01)

(58) Field of Classification Search

CPC ..... B65D 47/08; B65D 47/0804; B65D 47/0833; B65D 47/0838; B65D 47/0842; B65D 2543/00101; B65D 2543/0012

USPC ..... 220/254.1, 254.3, 254.4, 254.7; 215/235, 236, 237

See application file for complete search history.

(56) References Cited

U.S. PATENT DOCUMENTS

| | | | | |
|---|---|---|---|---|
| 3,002,668 | A * | 10/1961 | Castelli | 225/52 |
| 5,050,737 | A | 9/1991 | Joslyn et al. | |
| 7,537,137 | B2 * | 5/2009 | Giraud | 220/839 |
| 7,628,297 | B2 * | 12/2009 | Pugne | 222/556 |
| 2002/0162765 | A1 | 11/2002 | Okin et al. | |
| 2005/0258180 | A1 | 11/2005 | Lown | |
| 2008/0156806 | A1 | 7/2008 | Perry et al. | |
| 2010/0140266 | A1 * | 6/2010 | Lohrman et al. | 220/254.3 |

FOREIGN PATENT DOCUMENTS

KR 20-0448323 Y1 4/2010

* cited by examiner

*Primary Examiner* — Fenn Mathew
*Assistant Examiner* — Madison L Poos
(74) *Attorney, Agent, or Firm* — Kimberly-Clark Worldwide, Inc

(57) ABSTRACT

The present invention provides a resealable closure system that may be incorporated into a container for storing and dispensing moisture sensitive product, such as a dry wiping substrate and more preferably a dry wipe useful for facial cleansing or the application of make-up. The closure system is not only resealable, but is also substantially watertight as a result of the lid having a sealing flange and an overhang.

15 Claims, 4 Drawing Sheets

WATERTIGHT CLOSURE SYSTEM

BACKGROUND

Containers suitable for dispensing wiping substrates, both dry and wet, are known in the art. Containers typically are either flexible or rigid and include a dispensing orifice to allow the consumer convenient access to the substrate. In the containers of the prior art these openings are generally situated on the upper face of the container. In order to prevent egress of moisture in the case of wet wiping substrates or the ingress of moisture in the case of dry wiping substrates, known containers generally comprise a lid and a sealing device.

A problem with containers of the prior art is that the sealing device often makes it difficult for the consumer to access the wipes within the container. The sealing device may make it difficult for a consumer to open and close the lid or may obscure the dispensing orifice and impede dispensing. The sealing device may also make it difficult to dispense multiple wipes at one time. For example, the sealing device may only permit access to a single wipe, making it difficult to quickly dispense multiple wipes without damaging the wipes, damaging the container or abrading the skin against the edges of the container.

In addition to making dispensing more difficult, sealing devices of the prior art often increase the complexity and cost of the container. For example, U.S. Pat. No. 7,213,720 provides a cap assembly for storing and packaging moisture-sensitive items, however, the cap includes a lip seal member that must be aligned with an opposing skirt and must be positioned so as to apply pressure to the skirt. Further, an elastomeric liner may be positioned between the skirt and the lip to improve the water-tightness of the seal. Such a design increases the complexity of both the lid and the skirt, introduces additional materials in the form of an elastomeric liner and negatively effects dispensing by introducing additional features to the dispensing orifice.

It is therefore an objective of the present invention to provide a rigid container from which a dry wiping substrate can be easily dispensed, while also providing a means for preventing the ingress of water in a simple and cost effective manner.

SUMMARY

The present invention provides a resealable closure system that may be incorporated into a container for storing and dispensing moisture sensitive product, such as a dry wiping substrate and more preferably a dry wipe useful for facial cleansing or the application of make-up. The closure system is not only resealable, but is also substantially watertight. That is, when the closure system is integrated with a container, the closure system substantially prohibits the ingress of water into the container through the lid when the lid is in a closed position.

Accordingly, the present invention solves the problem of providing a simple, cost effective and functional watertight closure system by providing a lid having a pair of downwardly extending flanges disposed along each side edge, the flanges extending beyond the base of the closure system when the lid is in a closed position, and a front edge that extends horizontally beyond the vertical plane of the front edge of the base when the lid is closed. These three components (pair of side flanges and overhanging front edge), which are preferably integral to the lid and made form the same material, effectively prevent the ingress of water and allow for the dry storage of wiping substrates even when the container is stored in a wet environment, such as a shower.

In one embodiment the present invention provides a lid attached to a base member by a hinge. The lid, which is preferably rectangular, although it may be any shape, comprises a pair of downwardly extending flanges and a front edge that forms an overhang. When the lid is in a closed position the flanges extend beyond the upper edge of the base member and the overhang extends beyond the front edge of the base member.

In another embodiment the present invention provides a closure system comprising a base having a front edge, a rear edge and a pair of opposed side edges; a lid having a front edge, a rear edge, a pair of opposed side edges and a pair of flanges extending at least partially along each of the side edges, the flanges extending substantially vertically downward from the horizontal plane of the lid; and a hinge that operatively connects the lid to the base in a movable arrangement, wherein the front edge of the lid extends beyond the vertical plane of the front edge of the base when the lid is in a closed position.

In still another embodiment the present invention provides a container comprising a cup-shaped container body having a bottom and a generally annular sidewall defining an open end; a lid having a main body having opposed front and back edges and opposed side edges, the lid sized large enough to close the open end of the container body, a pair of sealing flanges extending from a bottom surface of the main body and beyond the annular sidewall in a closed position, the lid further comprising an overhanging front edge that extends beyond the annular sidewall in a closed position; a living hinge coupling the container lid and container body into a one-piece construction, the container lid pivoting through the living hinge between an open position and the closed position.

In yet other embodiments the present disclosure provides a watertight dispenser comprising a container body having a bottom and a generally annular sidewall defining an open end and a closure system sized to cover the open end of the container, the closure system comprising a base, a lid and a hinge, wherein the lid comprises a pair of sealing flanges that extend downward from the horizontal plane of the lid and beyond the base and an overhanging front edge that extends beyond the vertical plane of the front edge of the base when the lid is in a closed position.

Other features and embodiments of the present invention are discussed in greater detail below.

DESCRIPTION OF THE DRAWINGS

Various non-limiting embodiments are further described with reference to the accompanying drawings in which.

DETAILED DESCRIPTION

Figure 1:
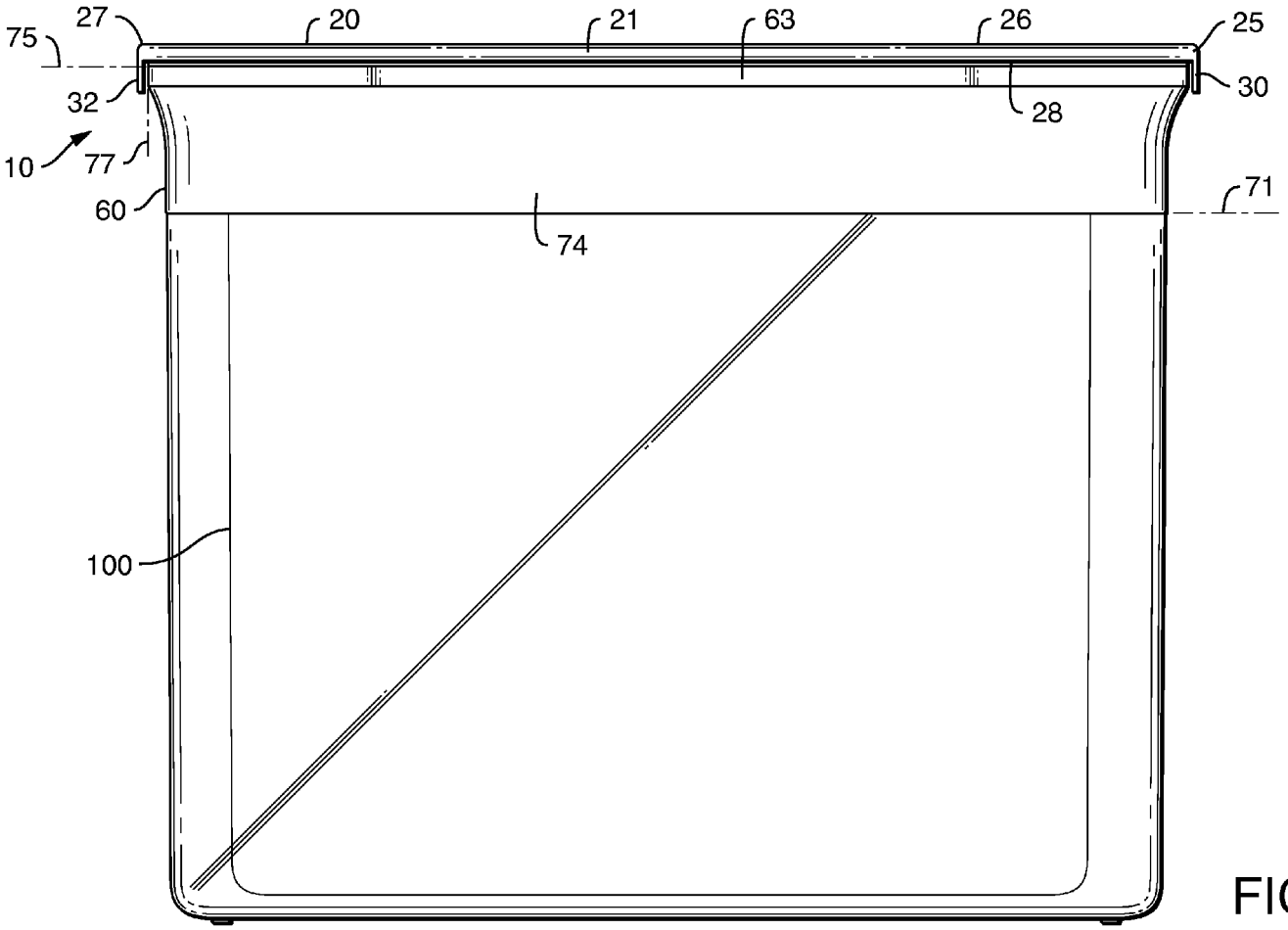
FIG. 1 illustrates a front view of a closure system engaged with a container according to one embodiment of the present invention.

Various embodiments or features are described with reference to the drawings, wherein like reference numerals are used to refer to like elements throughout. In the following description, for purposes of explanation, numerous specific details are set forth in order to provide a thorough understanding of the subject disclosure. It may be evident, however, that the disclosed subject matter can be practiced without these specific details, or with other methods, components, materials, and so forth.

By way of introduction, the present invention provides a watertight closure system comprising a lid, a hinge and a base member. The base member may either be a container having a bottom and a generally annular sidewall defining an open upper portion or may simply be an annular sidewall having open top and bottom portions that may be coupled with, or otherwise joined to, a container. When the lid is in a closed position, the lid, hinge and base member form a closure system that prevents the ingress of water. In this manner, the system may be used as a closure system for a container of dry, disposable, personal cleansing articles which may be useful for cleansing the skin or hair and/or delivering skin or hair care actives to the skin or hair. Generally such articles are used by the consumer by wetting the dry article with water. Prior to use however, it is desirable to maintain the articles in a dry state. Therefore, it is preferred that the articles be stored in a container having a lid that prevents the ingress of water.

For example, in one embodiment the closure system is integrated with a container having a bottom and a generally annular sidewall defining an open upper portion upon which the bottom surface of a lid seats when the lid is in the closed position. Further, when the lid is in a closed position, the front edge of the lid extends beyond the horizontal plane of the annular sidewall thereby defining an overhanging front edge. The lid also comprises a sealing flange that extends downward from the lid and beyond the vertical upper portion of the container. In this manner the lid includes elements along its periphery that prevent ingress of water into the container and allow the contents thereof to remain dry even when the container is stored in a moist environment such as a shower.

Turning to the figures, FIG. 1 illustrates a closure system 10 according to one embodiment of the present invention. The closure system comprises a lid 20 and a base member 60, which are preferably joined by a hinge (not illustrated in FIG. 1). As noted previously, in certain embodiments the closure system 10 may be affixed to a container 100, such as a container for storing and dispensing dry wiping products. The base member 60 and lid 20 are shown to be of a somewhat square-like (i.e., four-sided) or generally rectangular shape and are generally complementary to the shape of the container in-use. However, other shapes and configurations of the base and lid, such as round or circular, are contemplated and are intended to fall within the scope of the invention. The invention is not to be limited to a specific base or lid perimeter shape or overall contour.

In general, the lid 20 is sized to fit over the base member 60 during use. Further, the base member 60 is preferably configured to receive the lid 20 when it is in a closed position and the lid 20 is configured to be positioned over the base member 60 in a manner that forms a seal there between and prevents the ingress of water.

In accordance with certain embodiments, the base member 60 and the lid 20 can be made of the same material or of a similar material. In some embodiments, the base member 60 and the lid 20 are formed of different materials. According to certain embodiments, the base member 60 and/or the lid 20 are formed of an injection molded suitable thermoplastic material (e.g., polymer, polypropylene, and so forth) or other material known in the art.

The base member 60 and the lid 20 can be a one-piece structure or the base member 60 and lid 20 may comprise a two-piece structure. Regardless, the lid 20 is preferably pivotally joined to the base member 60 by, for example, a hinge 40. The hinge 40 can be configured to mitigate cracks that might develop at or along one or more flex portions of the hinge 40 and can be constructed of a relatively thin wall that is configured to flex without breakage during an expected service life of the closure system 10. For example, the hinge 40 can be formed of a material that has at least some flexibility and/or that can deform slightly or significantly in order to mitigate cracking and/or breakage of the hinge 40. In accordance with some embodiments, the hinge 40 can be formed with the same or similar material as the base member 60 and/or the lid 20. In other embodiments, the hinge 40 can be formed of a material that is different than the material used to form the base member 60 and/or the lid 20.

The hinge can be a "living hinge", a "pivoting hinge", or another type of hinge. A living hinge is a hinge formed with the base member 60 and the lid 20 as a single piece. A living hinge can be configured to facilitate the lid 20 being able to spring away from the base member 60 when the closure system 10 is to be opened. A pivoting hinge is formed at substantially the same time as the body portion (or the lid), wherein the body portion and the lid 20 are formed as separate pieces and snapped together at the hinge to combine the two pieces into a single container assembly.

The hinge 40 provides ease of moving the lid 20. For example, the hinge 40 operatively connects the lid 20 to the base member 60 in a movable arrangement, wherein the lid 20 comprises at least two positions, namely, a first position and a second position. When in the first position, the lid 20 is "open" (or moved away from the base member 60), which allows product (e.g., a specimen) to be placed into the closure system 10 (e.g., into the base member 60) and/or dispensed from the closure system 10. When the lid 20 is in the second position, the lid 20 is closed or engaged with the base member 60, providing a secure and watertight seal according to various embodiments disclosed herein. Thus, the hinge 40 allows the lid 20 to be moved away from the base member 60 (e.g., flipped up, placed into first position) for dispensing and/or for filling. The hinge 40 can allow the lid 20 to be moved into contact with the base member 60 (e.g., placed into the body position) for storage, transport purposes, and/or for other purposes.

Figure 2:
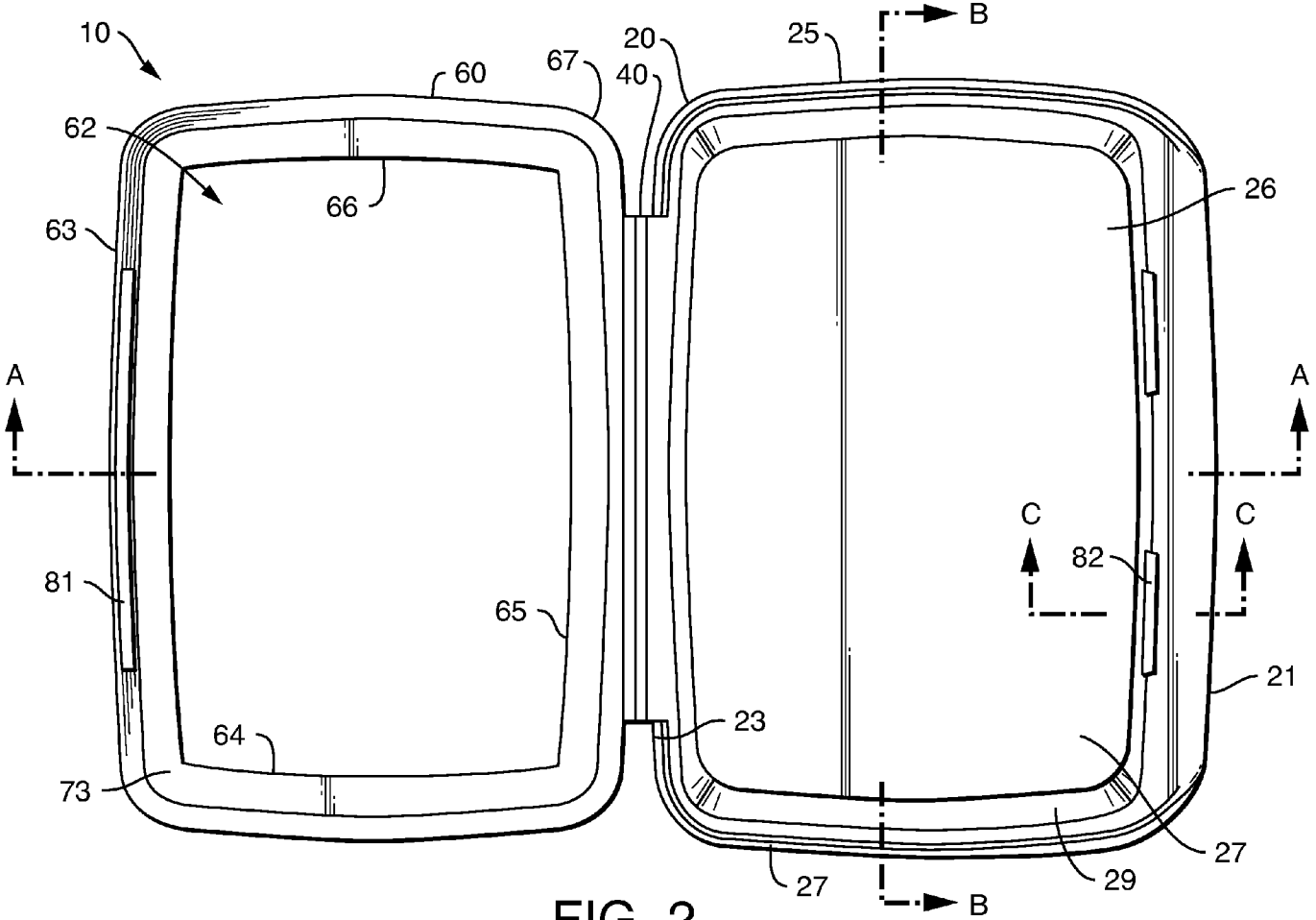
FIG. 2 illustrates top view of a closure system according to one embodiment of the present invention.

In a particularly preferred embodiment, such as that illustrated in FIG. 2, the lid 20 is formed with the base member 60 as a one-piece construction and is not formed as a plurality of parts separately attached together. The two components are joined by a living hinge 40 that attaches the lid 20 to the base member 60. The living hinge 40 allows the lid 20 to pivot relative to the base member 60 between open and closed positions while permanently securing the lid 20 to the base member 60. In certain embodiments the closure system may be combined with a container such that when the lid is in an open position the contents stored within the container can be accessed. In a preferred embodiment, the closure system forms a water tight seal relative to the container body in the closed position. Permanently attaching the lid 20 to the base member 60 provides the additional benefit that the lid cannot be lost or displaced from the base.

Ordinarily, the lid 20 is installed upright on the top of the base member 60 that has a mouth 62 that typically lies in a horizontal plane. For purposes of discussion, the vertical direction generally corresponds to an axial direction with reference to the geometry of the closure system (comprising the body portion and the lid) and the horizontal direction or horizontal plane is perpendicular to the axial direction of the closure system (e.g., the vertical direction). It should be understood that during fabrication, molding, shipping, storage, and so forth, the base member 60 and/or lid 20 could have a non-upright orientation.

As illustrated in FIG. 2, the base member 60 annular sidewall 74 defines an open upper end 68. As further illustrated in FIG. 4, the annular sidewall 74 has upper 70 and lower 72 edges. The upper edge 70 defines the upper horizontal plane 75 of the base member 60 and the lower edge of the annular sidewall 74 defines the lower horizontal plane 71 of the base. The base member 60 is substantially rectangular and has a pair of opposed side walls 64, 66 and opposed front and back walls 63, 65.

The lid 20, which is generally shaped to cover the base member 60 has a main body 26 having a generally annular shaped peripheral edge that comprises front 21, rear 23 and opposing side edges 25, 27, which together form the outer peripheral edge of the lid.

Figure 4:
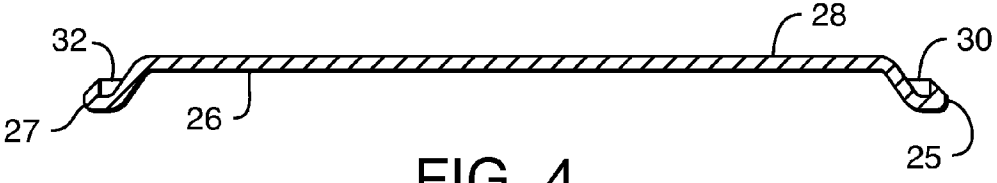
FIG. 4 illustrates a cross section view of a lid (through line B-B of FIG. 1) according to one embodiment of the present invention.
Figure 3:
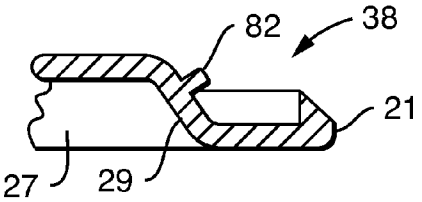
FIG. 3 illustrates a cross section view of a portion of a lid (through line C-C of FIG. 1) according to one embodiment of the present invention.

As illustrated in FIGS. 1 and 4, extending downwardly from each side edge 25, 27, in a direction substantially perpendicular to the plane of the main body 26, are a pair of sealing flanges 30, 32. The sealing flanges 30, 32 are illustrated in detail in FIG. 4, which is a cross section view of a lid. The sealing flanges 30, 32 may be considered part of the lid 20. The sealing flanges 30, 32 extend axially from the main body 26 and more particularly from the bottom surface 28 of main body 26.

When the lid is in a closed position, the sealing flanges 30, 32 generally extend in an axially downward direction from the lid 20 beyond the horizontal plane 75 of the base. In this manner the sealing flanges 30, 32 form a seal along at least a portion of both side edges 64, 66 and prevent the ingress of water. When the sealing flanges are employed with an overhang along the front edge of the lid, as described in more detail below, there is no need for additional seals between the base member and the lid. The combination of sealing flanges and overhang provide a simple and effective means of preventing water from entering the closure system.

The flanges 30, 32 may be any suitable shape, so long as they extend substantially vertically from both edges 25, 27 of the lid 20 towards the base member 60. In a particularly preferred embodiment the sealing flanges are preferably wedge shaped such that it has a wider base portion proximate main body and a narrower distal tip spaced axially away from main body.

In one particularly preferred embodiment of a sealing flange, the outer surface of the flange is radially shaped having a radius from about 0.01 to about 0.1 inches. In other embodiments the outer surface of the flange may be canted inwards toward the base member when the lid is in a closed position. The inner surface is preferably substantially perpendicular to the horizontal plane of the main body forming an angle between about 90 and about 93 degrees. When the lid is in a closed position the inner flange surface is preferably parallel to the vertical plan of the base, but is spaced away from the base member such that there is a space between the inner flange surface and the base member.

While the sealing flange may generally be any size and shape so long as it seals the edges of the closure system when the lid is in a closed position, in a preferred embodiment the flange has a tapered shape. Accordingly, in one embodiment the flange base has a width of between about 0.03 and 0.1 inches (measured parallel to the bottom surface of main body) and a width of between about 0.02 and 0.05 inches at the distal tip. In a preferred embodiment, the height of the sealing flange is substantially constant the entire length of the sealing flange. Preferably, the flange has a height between about 0.1 and 0.5 inches and more preferably between about 0.2 and about 0.3 inches.

As illustrated in FIG. 1, the flanges 30, 32 extend downwardly from the side edge 25, 27 towards the base member 60 when the lid 20 is in a closed position. In this manner, the flanges 30, 32 extend vertically beyond the horizontal plane 75 of the base a distance of at least about 0.05 inches, such as from about 0.05 to about 0.25 inches. In a particularly preferred embodiment, such as the embodiment illustrated in FIG. 1, the flanges 30, 32 extend downwardly beyond the vertical plane 75 of the upper edge 70 of the base member 60 but do not contact the edge when the lid is in a closed position. In this manner there is a slight gap between the flanges 30, 32 and the base member 60, such as from about 0.01 to about 0.1 mm and more preferably from about 0.05 to about 0.075 mm, as illustrated in FIG. 1.

The flanges 30, 32 extend at least partially along each side edge 25, 27. More preferably the flanges 30, 32 extend along the entire length of each side edge 25, 27. In a particularly preferred embodiment the flanges 30, 32 extend along the entire length of each side edge 25, 27 and at least partially along the rear edge 23. In a particularly preferred embodiment, such as the embodiment illustrated in FIG. 2, the flanges 30, 32 extend along the entire length of each side edge 25, 27 and along a portion of the rear edge 23, terminating immediately adjacent to the hinge 40. In this manner, the flanges and the hinge prevent the ingress of water along the entirety of the side and rear edges.

The flanges 30, 32 may extend along the front edge 21, however, as described below, the front edge 21 forms an overhang 38 and therefore there is generally not a need for additional barriers to the ingress of water along the front edge 21. Thus, in a preferred embodiment the front edge 21 does not include a flange, but rather, the flanges 30, 32 terminate immediately adjacent to the front edge 21. In those embodiments where the edges of the lid are joined by rounded corners, such as the embodiment illustrated in FIG. 2, the flanges may extend at least partially around the rounded corners.

In addition to having a pair of sealing flanges that extend beyond the horizontal plane of the upper edge of the base when placed in a closed position, the lid 20 includes a front edge 21 that extends beyond the front edge 63 of the base. In this manner the front edge 21 forms an overhang 38 that is substantially planer with the lid 20 and perpendicular to the vertical plane 77 of the base. Preferably the overhanging front edge 21 extends at least about 0.0.5 inches and more preferably from 0.1 to about 0.3 inches, beyond the vertical plane 77 of the base. Providing a lid edge that overhangs the base provides numerous advantages, such as providing a surface that is easy for the user to grasp when opening the lid and preventing the ingress of water along the front edge of the base.

Figure 6:
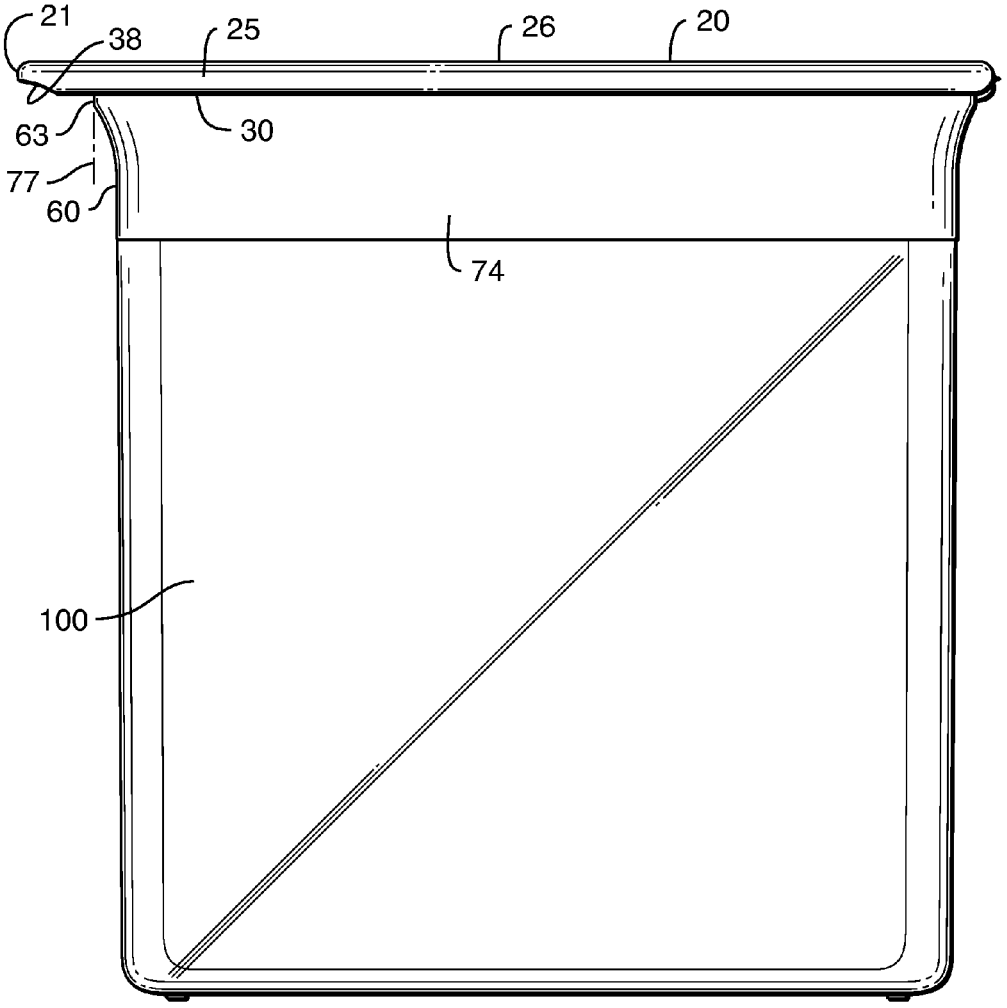
FIG. 6 illustrates a side view of a closure system engaged with a container according to one embodiment of the present invention.

In one preferred embodiment, the closure system comprises only one overhang, which is disposed along the front edge of the lid. In this manner the overhang 38 forms a drip edge to facilitate the flow of liquid off the lid 20 along its front edge 21. As illustrated in FIG. 6, the top and bottom surfaces of the overhang 38 are generally parallel to one another and substantially parallel to the horizontal plane of the lid 20. In alternate embodiments the overhang is curved generally downwardly to form a drip edge to facilitate the flow of liquid off the lid. Other cross-sectional shapes are also possible depending on the particular application in which lid will be used.

Turning again to FIG. 5, which is a cross section of FIG. 2 through line A-A, a particularly preferred embodiment of a lid 20 is illustrated. In the illustrated embodiment the lid 20 has a central recessed or sunken section 36 surrounded by a vertical upstanding lid wall 29 that faces the recessed section 36. In the disclosed example, the lid wall 29 has four side segments that correspond to the four-sided shape of the lid 20. To receive the lid 20 the upper edge 70 of the base is provided with a lip 73 that extends radially outward. In this manner the downwardly extending wall 29 defines the peripheral edge of the central depressed portion 36 and the lip 73 defines the peripheral edge of the central open portion, or mouth 62 of the base. In a preferred embodiment the periphery of the central depressed portion 36 is slightly greater than the periphery of mouth 62 of the body so that at least a portion of the depressed central portion 36 contacts the lip 73 when the lid 20 is in a closed position.

In the above described embodiment when the lid is in a closed position the surfaces of the depressed central portion and the lip are parallel to one another and orientated substantially horizontally. Similarly, when the lid is in a closed position the surfaces of the downwardly extending wall and the upper peripheral wall of the base are parallel to one another and generally canted outwardly.

With reference again to FIG. 2, in one particularly preferred embodiment the base member 60 is defined by opposing side walls 64, 66 and front 63 and back 65 walls. As discussed previously, while the body shown in the drawings has a rectangular shape, the container of the present invention may have a circular or oval shape with only a peripheral upstanding wall. In a particularly preferred embodiment the front 63, back 65 and side walls 64, 66 of the base member 60 are merged via rounded corners 67, as shown in FIG. 2. In this manner, the front 63, back 65 and side walls 64, 66 form a peripheral wall that defines the base member 60.

Figure 5:
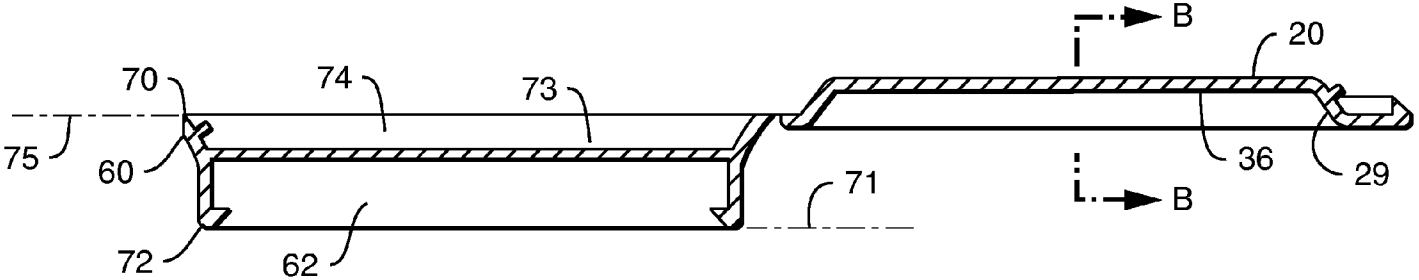
FIG. 5 illustrates a cross section view of a closure system (through line A-A of FIG. 1) according to one embodiment of the present invention.

Further details of one preferred embodiment of the base member 60 will now be discussed with reference to FIG. 5, which is a cross-section view of FIG. 2 through line A-A-A. As shown in FIG. 5, the base member 60 is defined by a peripheral wall 74 having upper 70 and lower 72 edges. In the preferred embodiment illustrated in FIG. 2, the upper 70 and lower 72 edges lie at either end of a wall having three distinct segments a lower segment, which terminates at the lower edge 72, a middle segment, and an upper segment, which terminates at the upper edge 70. The middle segment preferably has a concave outer surface having a radius from about 0.3 to about 0.5 inches. The upper segment extends above and beyond the concave middle segment and generally parallel to the lower segment.

With further reference to FIG. 5 and turning to the inner surface of the peripheral wall defining the base member 60, illustrated is a central opening 62, also referred to as a mouth, defined by a lip 73 extending substantially perpendicular to the peripheral wall and inwardly towards the opening 62. Preferably the lip 73 extends along the entire interior of the peripheral wall and is recessed from the plane of the upper edge 70 simplifying the manufacturing process and allowing the lid 20 to overlie base member 60 when in a closed position.

The portion of the interior peripheral wall extending above and beyond the lip 73 is disposed at an angle of about 100 to about 140 degrees and preferably about 110 to about 120 degrees from the horizontal plane of the lip 73. This slight angle facilitates the entry of a depressed central portion of the lid to enter the mouth and form an interference or sealing fit when the lid is in a closed position.

The base 60 can include a latch with an elongate first rib 81 projecting horizontally therefrom, and the lid 20 can include a catch with an elongate second rib 82 projecting horizontally therefrom. The first and second ribs 81 and 82, respectively, can removably engage each other in an interference fit to maintain the lid closed and removably disengage each other when the lid is opened.

We claim:

1. A closure system comprising a base having an annular sidewall and a central opening; a lid configured to substantially cover the central opening of the base, the lid having a front, a rear edge having a length and a pair of opposed side edges having a length; a pair of flanges having a height extending substantially vertically from and at least partially along the length of the side edges and at least partially defining a peripheral outer edge of the closure system; and a hinge that operatively connects the lid to the base in a movable arrangement, wherein the flanges do not extend along the front edge of the lid and the front edge of the lid extends beyond the vertical plane of the annular sidewall and the flanges extend beyond the horizontal plane of the annular sidewall when in a closed position.

2. The closure system of claim 1, wherein the hinge is a living hinge.

3. The closure system claim of 2, wherein the flanges extend along the entire length of both side edges and along a portion of the rear edge.

4. The closure system of claim 3, wherein the flanges terminate immediately adjacent to the living hinge.

5. The closure system of claim 1, wherein each flange has an inner and an outer surface, the outer surface biased radially outward and away from one another.

6. The closure system of claim 1, wherein the height of the sealing flange is substantially constant and the flange is spaced away from the base when the lid is in a closed position.

7. The closure system of claim 1, wherein the lid further comprises a depressed central portion.

8. The closure system of claim 1, wherein the lid further comprises a catch mechanism proximate the front portion of the lid, the catch mechanism engaging the base to hold the lid in a closed position.

9. The closure system of claim 1, wherein the lid further comprises a latch with an elongated rib extending horizontally therefrom and the body further comprises a second elongated rib extending horizontally therefrom whereby the first and second ribs removably engage one another in an interface fit to maintain the lid in a closed position.

10. A container comprising a cup-shaped container body having a generally annular sidewall defining an open end; a lid having a main body having a front edge, a back edge having a length and a pair of opposed side edges having a length, the lid sized large enough to close the open end of the container body, a pair of flanges extending from a bottom surface of the main body and beyond the horizontal plane of the annular sidewall in a closed position to at least partially define the outer peripheral edge of the lid and wherein the flanges extend along the entire length of both side edges and along a portion of the back edge, but do not extend along the front edge of the lid, the lid further comprising an overhanging front edge that extends beyond the vertical plane of the annular sidewall in a closed position; and a living hinge coupling the container lid and container body, the container lid pivoting through the living hinge between an open position and the closed position.

11. The container of claim 10, wherein the flanges terminate immediately adjacent to the living hinge.

12. The container of claim 10, wherein each flange has an inner and an outer surface, the outer surface biased radially outward and away from the inner surface.

13. A watertight dispenser comprising a container body having a bottom and a generally annular sidewall defining an open end and a closure system sized to cover the open end of the container, the closure system comprising a base, a lid and a hinge, wherein the lid comprises a rear edge having a length, a pair of opposed side edges having a length, a pair of flanges having a height that extend downward from the horizontal plane of the lid and beyond the horizontal plane of the base and at least partially defining a peripheral outer edge of the lid and wherein the flanges extend along the entire length of both side edges and along a portion of the rear edge, but do not extend along the front edge of the lid and an overhanging front edge that extends beyond the vertical plane of the front edge of the base when the lid is in a closed position.

14. The container of claim 13, wherein the flanges terminate immediately adjacent to the hinge.

15. The closure system of claim 13, wherein the height of the flange is substantially constant and is spaced away from the base when the lid is in a closed position.

* * * * *